US011364939B2

(12) United States Patent
Sarti et al.

(10) Patent No.: US 11,364,939 B2
(45) Date of Patent: Jun. 21, 2022

(54) PNEUMATIC SUSPENSION FOR RAILWAY VEHICLE

(71) Applicant: SpeedInnov, Paris (FR)

(72) Inventors: Christophe Sarti, Saint Medard D'Aunis (FR); Michel Martin, Le Creusot (FR); Philippe Dessertenne, Le Creusot (FR); Luis Mendes Frederico, Perigny (FR); Romain Goude, Le Mans (FR); Thierry Thommeret, Ivry sur Seine (FR)

(73) Assignee: SPEEDINNOV, Paris (FR)

( * ) Notice: Subject to any disclaimer, the term of this patent is extended or adjusted under 35 U.S.C. 154(b) by 360 days.

(21) Appl. No.: 16/570,787

(22) Filed: Sep. 13, 2019

(65) Prior Publication Data

US 2020/0086895 A1 Mar. 19, 2020

(30) Foreign Application Priority Data

Sep. 14, 2018 (FR) ..... 18 58328

(51) Int. Cl.
*B61F 5/12* (2006.01)
*B61F 5/10* (2006.01)
*B61F 5/52* (2006.01)

(52) U.S. Cl.
CPC ..... *B61F 5/127* (2013.01); *B61F 5/10* (2013.01); *B61F 5/52* (2013.01)

(58) Field of Classification Search
CPC ..... B61F 5/127; B61F 5/10; B61F 5/52
See application file for complete search history.

(56) References Cited

U.S. PATENT DOCUMENTS 3,438,339 A * 4/1969 Moehling ..... B61F 5/127 105/198.4
3,595,350 A * 7/1971 Wiebe ..... B61F 5/127 188/281

(Continued)

FOREIGN PATENT DOCUMENTS

DE 100 47 414 A1 1/2002
DE 103 53 416 A1 6/2004

(Continued)

OTHER PUBLICATIONS

Rapport De Recherche Preliminaire issued in corresponding French Patent Application No. 857186 dated May 20, 2019 (in French).

*Primary Examiner* — Jason C Smith
(74) *Attorney, Agent, or Firm* — Troutman Pepper Hamilton Sanders LLP

(57) ABSTRACT

The present invention relates to a pneumatic suspension for a rail vehicle comprising a body and a bogie, said pneumatic suspension extending between the body and a chassis of the bogie, comprising:

at least one secondary pneumatic suspension element for vertically supporting the body on the chassis and capable of being supplied with compressed air at a supply pressure, and a pressure source, wherein it further comprises:

a control unit, for each suspension element, a sensor connected to the command unit and able to measure a height between the chassis and the body at the level of said suspension element, and for each suspension element, a solenoid valve connecting said suspension element to the pressure source, said solenoid valve being commanded automatically by an (Continued)

electric command signal, generated by the command unit as a function of the measured height(s).

11 Claims, 1 Drawing Sheet

(56) References Cited

U.S. PATENT DOCUMENTS

| | | | | |
|---|---|---|---|---|
| 4,798,369 | A * | 1/1989 | Geno | B60G 17/01933 188/266.2 |
| 2017/0297591 | A1* | 10/2017 | Ogawa | B61F 5/24 |
| 2020/0047776 | A1* | 2/2020 | Leitgeb | B61F 5/02 |
| 2020/0086895 | A1* | 3/2020 | Sarti | B61F 5/127 |
| 2020/0102998 | A1* | 4/2020 | Aoki | F16F 9/185 |

FOREIGN PATENT DOCUMENTS

| | | | |
|---|---|---|---|
| DE | 10 2007 046 416 | A1 | 4/2008 |
| DE | 10 2007 050 151 | A1 | 4/2009 |
| EP | 2 483 124 | B1 | 9/2017 |
| FR | 3 053 301 | A1 | 1/2018 |
| JP | 7-309234 | A | 11/1995 |
| JP | 2006-192942 | A | 7/2006 |
| JP | 2010-228694 | A | 10/2010 |

* cited by examiner

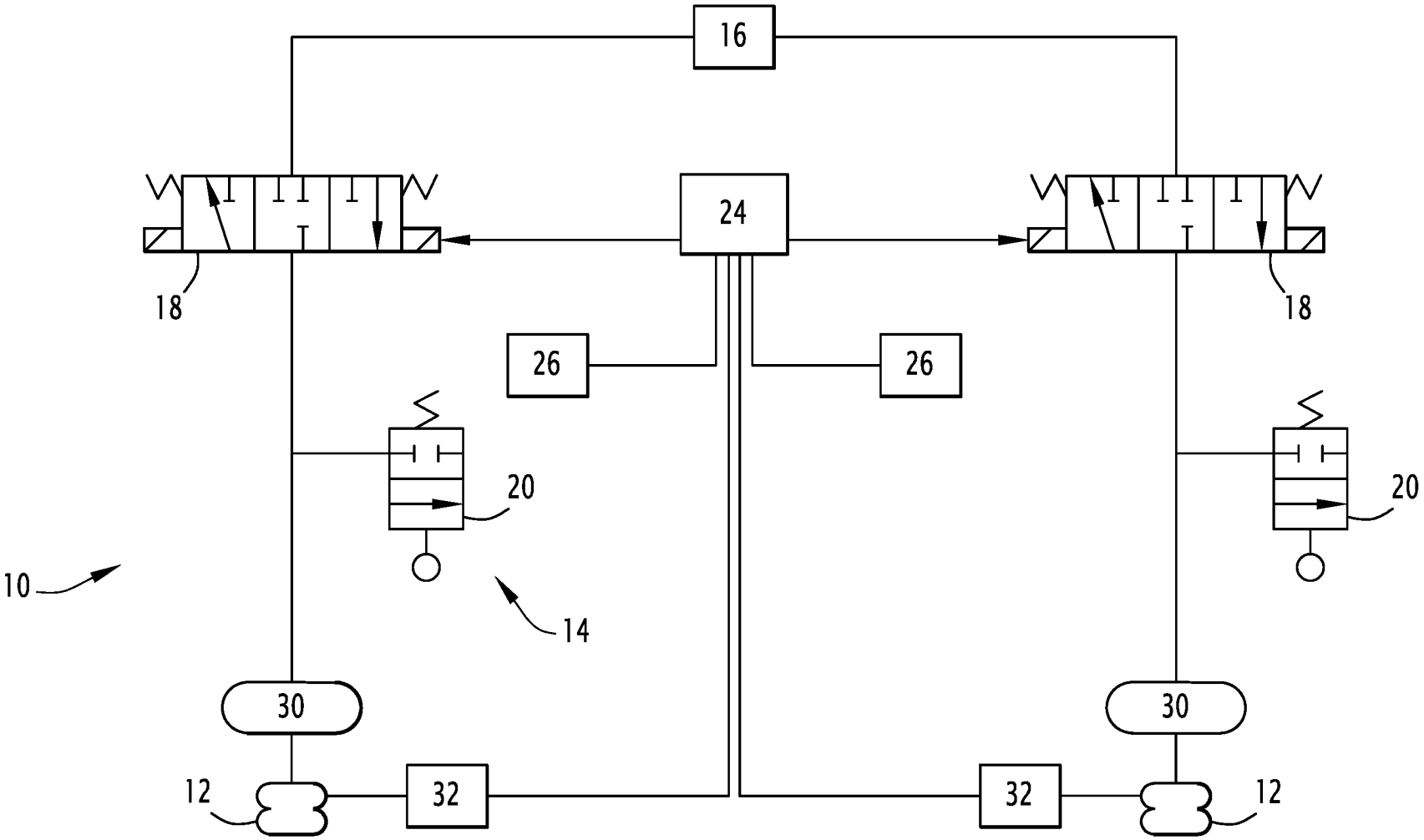
10
12
12
14
16
18
18
20
20
24
26
26
30
30
32
32

PNEUMATIC SUSPENSION FOR RAILWAY VEHICLE

CROSS REFERENCE TO RELATED APPLICATION

This application claims priority of French Patent Application No. FR 18 58328, filed Sep. 14, 2018. The entire contents of which are hereby incorporated by reference.

FIELD OF THE INVENTION

The present invention relates to a pneumatic suspension for a rail vehicle comprising a body and a bogie, said pneumatic suspension extending between the body and a chassis of the bogie, comprising at least one secondary pneumatic suspension element for vertically supporting the body on the chassis and capable of being supplied with compressed air at a supply pressure, and a pressure source.

The invention applies to the transportation field, in particular railway transportation.

BACKGROUND OF THE INVENTION

Pneumatic bogie suspensions, making it possible to control the height and the incline of a body of a rail vehicle on a bogie chassis, are known in the field of rail transport. Typically, they comprise four valves making it possible to control four suspension elements such as suspension pads, thus making it possible to control the incline of the body around two perpendicular axes. In a variant, suspensions with three valves also exist.

Document EP 2,483,124 B1 describes a bogie including a pneumatic suspension comprising four air springs. It in particular describes the control of these air springs using mechanical valves controlled via a control rod connected to the bogie. It also describes the use of differential valves between the air springs on two opposite sides, in order to pressure-balance these springs.

However, such mechanical components are bulky, costly, and demand substantial maintenance.

One of the aims of the invention is to propose a pneumatic suspension for a rail vehicle allowing leveling of the body with a reduced number of mechanical components.

SUMMARY OF THE INVENTION

To that end, the invention relates to a pneumatic suspension of the aforementioned type, further comprising a command unit, for each suspension element, a sensor connected to the command unit and able to measure a height between the chassis and the body at the level of said suspension element, and for each suspension element, a solenoid valve connecting said suspension element to the pressure source, said solenoid valve being commanded automatically by an electric command signal, generated by the command unit as a function of the measured height(s).

With the pneumatic suspension according to the invention, the incline and the height of the body are controlled using solenoid valves, making it possible to reduce the number of mechanical valves used relative to a conventional suspension, and thus making it possible to reduce the bulk, the cost, as well as the maintenance of such a pneumatic suspension.

According to certain embodiments, the pneumatic suspension comprises one or several of the following features, considered alone or according to any technically possible combinations:

- for each suspension element, the solenoid valve is commanded automatically by the associated electric command signal, to regulate the intake and/or discharge of air at said suspension element;
- the pneumatic suspension further comprises at least one pair of left and right suspension elements respectively arranged on a left side and a right side of a median longitudinal vertical plane of the chassis, each suspension element preferably being an air cushion;
- for each pair of left and right suspension elements, the electric command signals of the corresponding left and right solenoid valves are generated as a function of the heights measured by the corresponding left and right sensors, in particular as a function of the difference between the heights measured by the left and right sensors;
- the sensor is an ultrasound sensor compensated in pressure and temperature or a radar sensor;
- the pneumatic suspension further comprises, for each suspension element, a safety valve connected to said suspension element and configured to discharge compressed air from said suspension element when the height measured by the corresponding sensor exceeds a predetermined height threshold;
- the pneumatic suspension further comprises, for each suspension element, a reservoir connected in series between said suspension element and the corresponding solenoid valve; and
- the pneumatic suspension further comprises, for each suspension element, a pressure sensor capable of measuring the supply pressure of said suspension element.

The invention also relates to a rail vehicle including a bogie, a body, and a pneumatic suspension, the bogie comprising a chassis and the pneumatic suspension extending between the chassis and the body, characterized in that the pneumatic suspension [is] as previously described.

According to certain embodiments, the rail vehicle comprises the following features: each sensor of the pneumatic suspension is respectively capable of measuring the height between the chassis and the body of said rail vehicle, at the level of the corresponding suspension element.

BRIEF DESCRIPTION OF THE INVENTION

The invention will be better understood upon reading the following description, provided solely as an example, in reference to the sole FIGURE, which is a schematic illustration of a pneumatic suspension according to the invention in particular including a pair of suspension elements.

DETAILED DESCRIPTION OF THE PREFERRED EMBODIMENTS

A pneumatic suspension 10 for a rail vehicle is illustrated in the sole FIGURE.

This pneumatic suspension 10 is intended to equip a rail vehicle including a body and a bogie. The pneumatic suspension 10 is in particular arranged between a chassis of the bogie and the body. It conventionally includes primary suspension elements, not shown, and at least one secondary pneumatic suspension element 12. In the remainder of the description, a pneumatic suspension 10 comprising several secondary pneumatic suspension elements 12 will be described.

The suspension elements 12 vertically support the body on the chassis, and are for example suspension pads supplied by a pneumatic circuit 14 supplying compressed air under a supply pressure to the suspension elements 12. The body is raised by the suspension elements above the chassis at a height depending on the discharge/intake of air from/to the suspension elements 12. In other words, by activating the intake of air into the suspension elements 12, the height of the suspension element, measured in the elevation direction of the rail vehicle, increases, which causes the height between the chassis and the body to increase.

In the described example, the pneumatic suspension 10 advantageously comprises at least one pair of suspension elements 12, namely a left suspension element and a right suspension element respectively arranged on a left side and a right side of a median longitudinal vertical plane of the chassis, symmetrically relative to this plane. Preferably, the pneumatic suspension 10 comprises a front pair and a rear pair of left and right suspension elements 12.

The pneumatic circuit 14 includes a pressure source 16 making it possible to supply compressed air to the suspension elements 12 and, for each suspension element 12, a solenoid valve 18 connecting the pressure source 16 to the corresponding suspension element 12.

The solenoid valve 18 is known in itself and is a valve commanded by an electric command signal. It is configured to regulate the intake and/or discharge of air to/from the corresponding suspension element 12, as a function of the electric command signal. It comprises three positions: a closed position, in which the fluid circulation between the source 16 and the suspension element 12 and between the suspension element and the outside is prevented, and an open intake position in which the solenoid valve 18 allows the compressed air to circulate from the source 16 to the suspension element 12, and an open discharge position in which the solenoid valve 18 allows the compressed air to escape from the suspension element 12 into the atmosphere.

Advantageously, the intake and/or the discharge of air at each suspension element 12 is done at constant pressure and variable volume via the modification of the height of the suspension element 12.

In a variant, the solenoid valve 18 is configured to regulate the pressure in the corresponding suspension element 12.

In an optional addition, the pneumatic circuit 14 further includes, for each suspension element 12, a safety valve 20 advantageously connected to the corresponding suspension element 12 and preferably fastened on the bogie chassis.

The safety valve 20 is known in itself and is a so-called end-of-travel mechanical valve. It is capable of discharging air from the suspension element 12 when the height measured by the corresponding sensor 26 exceeds a predetermined height threshold. This can in particular be due to a malfunction of the solenoid valve 18 blocked in the open intake position.

The safety valve 20 comprises a closed position, in which the fluid circulation between the suspension element and the outside is interrupted, and an open position in which the safety valve 20 allows compressed air to circulate from the suspension element 12 into the atmosphere. It for example includes a cable connected to the chassis and allowing mechanical actuation of the passage of the safety valve 20 from the closed position to the open position, when the body is raised past a predefined height above the chassis by the suspension element 12, which corresponds to a height above the predefined height threshold.

The pneumatic suspension 10 further comprises a command unit 24 electrically connected to each solenoid valve 18 and configured to automatically command the solenoid valves 18, and for each suspension element 12, a sensor 26 electrically connected to the command unit 24 and able to measure a height between the chassis and the body at the level of the corresponding suspension element 12. The height between the chassis and the body corresponds substantially to the height of the suspension element 12, to which may potentially be added the height of the connection elements between the suspension element and the chassis, on the one hand, and the suspension 12 and the body, on the other hand.

The command unit 24 is for example an electronic circuit able to calculate and generate, for each solenoid valve 18, an electric command signal as a function of the heights measured by the sensors 26.

Advantageously, the command unit 24 generates, for each pair of left and right suspension elements 12, the electric command signals of the corresponding left and right solenoid valves 18, in particular as a function of the heights measured by the corresponding left and right sensors 26, and in particular as a function of the difference between these two measured heights.

The sensor 26 is known in itself and is for example a position sensor positioned on a lower part of the body, at the level of the corresponding suspension element 12, and being capable of measuring a distance considered along the elevation direction between a point on an upper part of the chassis and the current position of the sensor 26.

The sensor 26 is for example an ultrasound sensor compensated in pressure and temperature or a radar sensor.

As an optional addition, the pneumatic suspension 10 further comprises, for each suspension element 12, a reservoir 30 connected in series between the solenoid valve 18 and the corresponding suspension element 12. The reservoir 30 is able to store compressed air in order to increase the volume of air able to be supplied by the pressure source 16 and/or to reduce the rigidity of the suspension element 12.

As an optional addition, the pneumatic suspension 10 further comprises, for each suspension element 12, a pressure sensor 32 connected to the suspension element 12 and able to measure the supply pressure of the suspension element 12 and connected to the command unit 24 in order to verify the proper working of the pneumatic suspension 10.

During normal operation, the command unit 24 sends each solenoid valve 18 a respective electric command signal. This electric command signal is calculated as a function of the heights measured by the sensors 26.

As a function of the received electric command signal, the solenoid valve 18 does or does not change position, in order to regulate the intake of air into the suspension element 12, i.e., the supply of the suspension element 12. This regulation is equivalent to a regulation of the elevation height of the body above the chassis.

The automatic command of the solenoid valve 18 by the command unit 24 makes it possible to have governing of the height between the body and the chassis at each suspension element 12, which is in particular updated by the height measured by the sensor 26. This makes it possible to do away with the use of mechanical valves governed using a control rod, which are in particular more cumbersome, are which are used in conventional suspensions.

Furthermore, for a pair of left and right suspension elements 12, the command unit 24 generates command signals as a function of both the height measured by the corresponding left sensor 26 and the height measured by the corresponding right sensor 26. The command unit 24 generates these signals in particular as a function of the height difference between the two sensors 26, which corresponds to the difference between the heights measured by the two sensors 26. This makes it possible to have balancing between these two left and right suspension elements 12 in order to control the incline of the body, thus making it possible to do without the use of a differential valve.

The use of safety valves 20 makes it possible to prevent the height and/or the supply pressure from being too great, and therefore to avoid damage of the suspension elements 12.

The invention claimed is:

1. A pneumatic suspension for a rail vehicle comprising a body and a bogie, said pneumatic suspension extending between the body and a chassis of the bogie, comprising:

a secondary pneumatic suspension element vertically supporting the body on the chassis, the secondary pneumatic suspension element capable of being supplied with compressed air at a supply pressure and a pressure source, wherein the pressure source further comprises:

a command unit;

a sensor connected to the command unit, the sensor able to measure a height between the chassis and the body at a level of the secondary pneumatic suspension element, a solenoid valve connecting the secondary pneumatic suspension element to the pressure source, the solenoid valve being commanded automatically by an electric command signal, the electric command signal generated by the command unit as a function of the height between the chassis and the body at the level of the secondary pneumatic suspension element, and a safety valve connected to the secondary pneumatic suspension element, the safety valve configured to discharge compressed air from the secondary pneumatic suspension element when the height between the chassis and the body at the level of the secondary pneumatic suspension element exceeds a predetermined height threshold.

2. The pneumatic suspension according to claim 1, wherein the solenoid valve is commanded automatically by the electric command signal, the solenoid valve to regulate at least one of an intake and the discharge of compressed air from the secondary pneumatic suspension element.

3. The pneumatic suspension according to claim 1, comprising a pair of left and right suspension elements respectively arranged on a left side and a right side of a median longitudinal vertical plane of the chassis.

4. The pneumatic suspension according to claim 3, wherein the pair of left and right suspension elements are air cushions.

5. The pneumatic suspension according to claim 3, wherein a corresponding left and right solenoid valves to the pair of left and right suspension elements generate electric command signals, the electric command signals generated as a function of the heights measured by a corresponding left and right sensors.

6. The pneumatic suspension according to claim 5, wherein the electric command signals of the corresponding left and right solenoid valves are generated as a function of the difference between the heights measured by the left and right sensors.

7. The pneumatic suspension according to claim 1, wherein the sensor is an ultrasound sensor or a radar sensor, the ultrasound sensor compensated in pressure and temperature.

8. The pneumatic suspension according to claim 1, further comprising a reservoir connected in series between the secondary pneumatic suspension element and the solenoid valve.

9. The pneumatic suspension according to claim 1, further comprising a pressure sensor capable of measuring the supply pressure of the secondary pneumatic suspension element.

10. A rail vehicle comprises a pneumatic suspension according to claim 1.

11. The rail vehicle according to claim 10, wherein the sensor is capable of measuring the height between the chassis and the body of the rail vehicle at the level of the secondary pneumatic suspension element.

* * * * *